US010292214B2

(12) United States Patent
Boulard

(10) Patent No.: US 10,292,214 B2
(45) Date of Patent: May 14, 2019

(54) DEVICE FOR HEAT TREATING PRODUCTS BY MEANS OF MICROWAVES AND HEAT TREATMENT METHOD IMPLEMENTING SUCH A DEVICE

(71) Applicant: Michel Boulard, Marconnelle (FR)

(72) Inventor: Michel Boulard, Marconnelle (FR)

( * ) Notice: Subject to any disclaimer, the term of this patent is extended or adjusted under 35 U.S.C. 154(b) by 727 days.

(21) Appl. No.: 14/894,295

(22) PCT Filed: May 28, 2014

(86) PCT No.: PCT/FR2014/051256
§ 371 (c)(1),
(2) Date: Nov. 25, 2015

(87) PCT Pub. No.: WO2014/191681
PCT Pub. Date: Dec. 4, 2014

(65) Prior Publication Data

US 2016/0105931 A1 Apr. 14, 2016

(30) Foreign Application Priority Data

May 28, 2013 (FR) ..... 13 54820

(51) Int. Cl.
*H05B 6/80* (2006.01)
*H05B 6/64* (2006.01)
(Continued)

(52) U.S. Cl.
CPC ..... *H05B 6/80* (2013.01); *H05B 6/6402* (2013.01); *H05B 6/701* (2013.01); *H05B 6/707* (2013.01); *H05B 6/788* (2013.01)

(58) Field of Classification Search
CPC ..... H05B 6/788; H05B 6/6402; H05B 6/80; H05B 6/707; H05B 6/701
(Continued)

(56) References Cited

U.S. PATENT DOCUMENTS 4,631,380 A * 12/1986 Tran ..... A22C 11/006 219/697
5,834,744 A 11/1998 Risman
(Continued)

FOREIGN PATENT DOCUMENTS

FR 2 874 473 A1 2/2006
JP 2010-112669 A 5/2010
(Continued)

OTHER PUBLICATIONS

International Search Report dated Oct. 6, 2014 issued in corresponding application No. PCT/FR2014/051256.

*Primary Examiner* — Quang T Van
(74) *Attorney, Agent, or Firm* — Westerman, Hattori, Daniels & Adrian, LLP

(57) ABSTRACT

A device for heat-treating products using microwaves includes an enclosure (2), a drum (3) having at least one portion mounted inside the enclosure (2), a spacing (4) defined between the enclosure (2) and the drum (3), a support (5) positioned at least partially in the spacing (4) and designed to receive and transport products to be treated, and at least one module (6) for applying microwaves to the products, designed to introduce microwaves into the spacing (4). The drum (3) has a prism shape, extending according to the axis (30) of the drum (3), and including a plurality of sides (31; 31'; 31") extending parallel to the axis (30). The enclosure (2) includes, internally, several planar surfaces (20; 20'; 20") each oriented towards one (31; 31'; 31") of the sides of the drum (3) and extending parallel to the side of the drum.

20 Claims, 3 Drawing Sheets

(51) Int. Cl.
*H05B 6/78* (2006.01)
*H05B 6/70* (2006.01)

(58) Field of Classification Search
USPC ..... 219/690, 679, 696, 697, 695, 700, 701, 219/746, 748, 750, 762; 333/227, 228, 333/230
See application file for complete search history.

(56) References Cited

U.S. PATENT DOCUMENTS

| | | | |
|---|---|---|---|
| 2008/0302787 | A1 | 12/2008 | Erskine et al. |
| 2009/0283517 | A1 | 11/2009 | Mackay et al. |

FOREIGN PATENT DOCUMENTS

| | | | |
|---|---|---|---|
| WO | 2006/073909 | A2 | 7/2006 |
| WO | 2007/007068 | A1 | 1/2007 |

* cited by examiner

DEVICE FOR HEAT TREATING PRODUCTS BY MEANS OF MICROWAVES AND HEAT TREATMENT METHOD IMPLEMENTING SUCH A DEVICE

The present invention relates to a device for heat treating products by means of microwaves and a heat treatment method implementing such a device.

This invention relates to the field of heat treating products by means of microwaves.

Devices and methods are already known making it possible to perform such treatment.

In particular, document FR 2,874,473 describes a method and device for heat treating a flexible material.

This device includes an enclosure adopting the shape of a cylindrical portion as well as a cylindrical drum mounted rotating in the enclosure. The flexible material to be treated circulates on the cylindrical drum, between the cylindrical drum and the enclosure. This device also includes modules for applying microwaves to the flexible material to be treated. These modules are positioned near the drum and each include a microwave source (more particularly in the form of a magnetron) oriented and able to be oriented toward that drum.

This device has many drawbacks.

In particular, due to the shape of the enclosure, the waves penetrating inside the enclosure lose their progressivity, which causes the creation of stationary waves. The creation of such stationary waves prevents the electromagnetic energy of the waves from being converted into heat, which significantly reduces the performance of such a device.

Furthermore and according to another drawback, the cylindrical shape of the drum in no way allows mixing of the waves, which generates wall effects. These wall effects cause the appearance of zones that are heated little or not at all, which creates heterogeneity of the temperature, and consequently heterogeneity of the heating, and therefore of the treatment, of the material.

Lastly, in the context of industrial exploitation, the aforementioned drawbacks are amplified and are still more difficult to control due to the number and power of the microwave sources (magnetrons).

The present invention aims to resolve the drawbacks of devices of the state of the art.

To that end, the invention relates to a device for heat treating products by means of microwaves, this device including:

- an enclosure;
- a drum extending along an axis and at least part of which is mounted inside the enclosure;
- a space defined between the enclosure and the drum;
- a support, at least partially positioned in said space, and designed to receive and transport the products to be treated;
- at least one module for applying microwaves to the products to be treated, such a module being designed to introduce microwaves inside said space.

This device is characterized in that:

- the drum adopts the form of a prism, extending along the axis of the drum, and including a plurality of sides extending parallel to the axis of the drum;
- the enclosure inwardly includes a plurality of planar surfaces each oriented toward one of the sides of the drum and extending parallel to such a side of that drum.

The invention also relates to a method for heat treating products by using microwaves, this method being implemented by the device described above.

This method includes a step consisting of inserting, by at least one of the microwave application modules, microwaves in said at least one volume defined by a planar surface of the enclosure and by a side of the drum, parallel to such a planar surface, when the drum is immobile relative to the enclosure.

Alternatively, this method may also consist on the one hand of ensuring the rotation of the drum around its axis and relative to the enclosure, and on the other hand of introducing, by at least one of the microwave application modules, microwaves inside the space defined between this enclosure and this drum.

Thus, the invention relates to a heat treatment device, including a drum with a plurality of sides on the one hand, and an enclosure with planar surfaces parallel to those sides on the other hand, and still further, microwave application modules that introduce microwaves inside the space defined between said drum and said enclosure.

Such a configuration advantageously allows the microwaves inserted into the space to retain their progressivity, and thus to avoid the formation of stationary waves that prevent the electromagnetic energy from those waves from being converted into heat. Keeping the progressivity of the microwaves then advantageously allows the electromagnetic energy of those microwaves to turn into heat, such that the performance of the device according to the invention is considerably better than that of the devices of the state of the art.

This configuration also makes it possible to ensure monomode operation of the device, without having to use mechanical means to mix the waves.

Another feature consists of the fact that the drum adopts the form of a prism including a plurality of sides and that the enclosure includes a plurality of planar surfaces each extending parallel to one such side of the drum. The sides of the drum and the planar surfaces of the enclosure then form an angle between them. The presence of these angles, sides and planar surfaces advantageously allows the microwaves to be better reflected and higher performing than in a cylinder of the state of the art where the microwaves are not on an angle and undergo a slipping effect.

The drum of the device can be fixed in the configuration described above (sides of the drum and planar faces of the enclosure parallel) and with the aforementioned advantages.

However, this drum can also be rotatable around its axis. When this drum is rotating, it advantageously constitutes a wave mixer allowing multi-mode operation of the device.

Another feature is that the drum and the support are separate and are movable, each independently of the other and/or at different speeds from one another.

This advantageously makes it possible to adapt the speed of the support (independently of that of the drum) and, consequently, the treatment time of the products received by that support within the device as a function of the characteristics of these products (uniformity of their volume, heterogeneity, composition, density, water content, etc.).

This also makes it possible to adapt the speed of the drum (independently of that of the support) that mixes the waves as a function of the heat treatment need of the products.

The features of the device according to the invention advantageously make it possible to diversify the products that can be heat treated, but also to diversify the application fields of the microwave treatment, relative to the devices of the state of the art.

In particular, this new device allows the drying, debacterization, disinsectization, extraction of active ingredients, sterilization, pasteurization (in particular of liquids), dehydration, freeze-drying, shaping (in particular bending, for example of wood), gluing, coating, pre-vulcanization, sintering, demineralization, welding, polymerization, forming, molding (vacuum or pressurized), curing of food products (cereals, fruits, tea, etc.).

Other aims and advantages of the present invention will appear in the following description relative to embodiments provided solely as indicative and non-limiting examples.

The comprehension of this description will be facilitated by referring to the appended drawings, in which.

Figure 1:
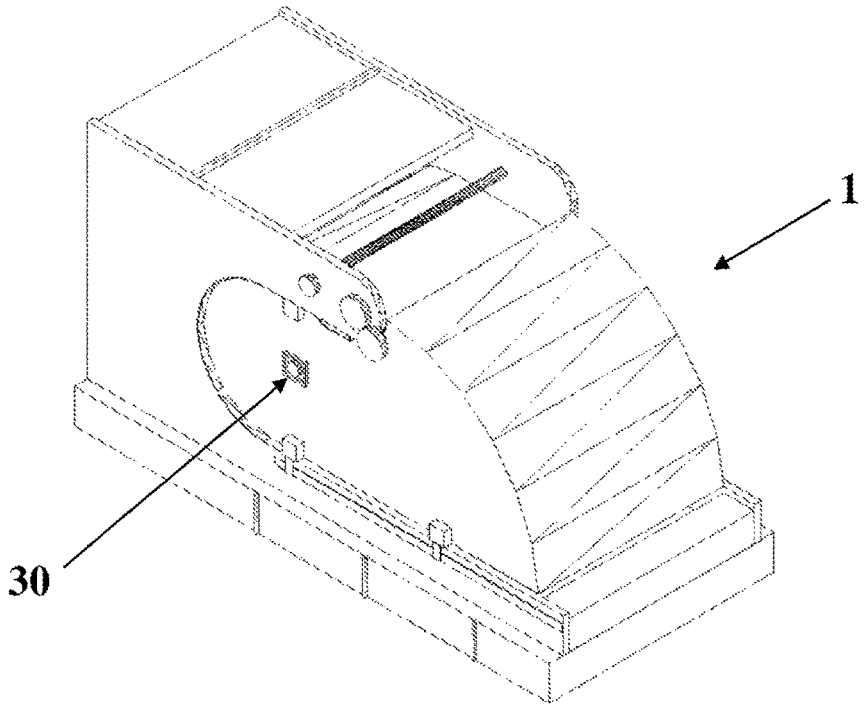
FIG. 1 is a diagrammatic perspective view of the device according to the invention.

The present invention relates to the field of heat treating products by means of microwaves.

These microwaves, also called hyperfrequency, occupy a range from 300 MHz to 30 GHz. In this respect, it will be noted that on the one hand and in France, this frequency is usually 2450 MHz, and on the other hand and in the United States, this frequency is usually 915 MHz.

The invention relates to a device 1 for heat treating products by means of microwaves.

Such a device 1 includes an enclosure 2, substantially making up the heating body, on the one hand, and a drum 3, extending along an axis 30, at least part of which is mounted inside the enclosure 2, on the other hand.

This device 1 also includes a space 4 defined between the enclosure 2 and the drum 3.

Said device 1 also includes a support 5, at least partially positioned in said space 4, and designed to receive and transport the products to be treated.

Lastly, this device 1 includes at least one module 6 for applying microwaves to the products to be treated, such a module 6 being designed to introduce microwaves inside said space 4.

According to the invention, the drum 3 adopts the shape of a prism, extending along the axis 30 of the drum 3, and including a plurality of sides (31, 31', 31") extending parallel to the axis 30 of the drum 3.

In this respect, it will be noted that said drum 3 includes at least six sides (drum in the form of a hexagonal prism).

However and according to one preferred embodiment of the invention, this drum 3 includes at least eight sides (drum in the form of a hexagonal prism), or even ten sides (drum in the form of a decagonal prism).

Indeed, good results are obtained for a drum 3 that includes eight sides (31, 31', 31"), and which has been illustrated in the appended figures.

Another feature consists of the fact that the drum 3 is rotatable around its axis 30. This feature advantageously makes it possible to mix the waves inside the space 4.

The device 1 then includes means for controlling the rotation of this drum 3. In particular, these control means include means for imparting a predetermined speed of rotation 3 to said drum, more particularly suitable for the heat treatment needs of the products.

One additional feature consists of the fact that the drum 3 is made from a material reflecting microwaves and/or not transparent to microwaves.

In particular, such a drum 3 can be made from stainless steel or a metal reflecting microwaves and/or not transparent to microwaves. However and according to one preferred embodiment, this drum 3 can also be made from glass (in particular a glass known under the trade name "Pyrex") filled with metal (in particular stainless steel), quartz filled with metal (in particular stainless steel), a composite material reflecting the waves (in particular a composite material filled with metal, for example stainless steel), which advantageously makes it possible to avoid any appearance of the product to be treated on the drum 3 during the treatment, but also to propose a material (glass, quartz, composite) that is less dangerous due to possible flashes with metal particles that may be found in the products to be treated.

Furthermore, such a material (glass, quartz, composite) filled with metal can be completed by a layer of glass making it possible to avoid any oxidation.

As mentioned above, the device 1 includes an enclosure 2.

According to the invention, this enclosure 2 inwardly includes a plurality of planar surfaces (20; 20'; 20") each oriented toward one (31; 31'; 31") of the sides of the drum 3 and extending parallel to such a side (31; 31'; 31") of that drum.

In this respect, it will be noted that the planar surfaces (20; 20'; 20") of the enclosure 2 are each oriented toward a different side (31; 31'; 31") of the drum 3 and are parallel to such a side (31; 31'; 31").

Such a feature advantageously makes it possible to define a parallelepiped volume between a planar surface (20; 20'; 20") of the enclosure 2 and a side (31; 31'; 31") of the drum 3. In such a parallelepiped volume, the microwaves are able to move while retaining their progressivity and avoiding the formation of stationary waves. In fact, such a planar surface (20; 20'; 20") of the enclosure 2 and such a side (31; 31'; 31") of the drum 3 constitute, advantageously and in combination, an oversized waveguide.

In this respect, it will be observed that the device 1 according to the invention also includes positioning means advantageously making it possible to guarantee the parallelism between the sides (31; 31'; 31") of the drum 3 and the planar sides (20; 20'; 20") of the enclosure 2.

According to another feature of the invention, said enclosure 2 includes a plurality of juxtaposed elements (21; 21'; 21") each including one of the planar surfaces (20; 20'; 20") as mentioned above and oriented toward one (31; 31'; 31") of the sides of the drum 3.

These elements (21; 21'; 21") are arranged so as to at least partially surround the drum 3, more particularly arranged to surround at least part of the sides (31; 31'; 31") of the drum 3.

As shown in the appended figures, these elements (21; 21'; 21") are arranged along an arc of circle whose center is combined with the axis 30 of the drum 3. Said enclosure 2 then adopts a "C" or "U" shape.

In one preferred embodiment of the invention, such an element (21; 21'; 21") is made up of a planar plate.

According to another feature, the least one such element 21 is movable relative to at least one other element 21', which is in particular adjacent.

In fact and according to a first embodiment, such an element 21 can be mounted articulated relative to the adjacent element 21', more particularly articulated to a transverse end of this other adjacent element 21'.

Such an embodiment advantageously makes it possible to ensure tilting of this element 21 on the one hand in a direction opposite that of the drum 3 so as to allow that drum 3 to leave said enclosure 2 (in particular for maintenance or replacement of said drum 3), and on the other hand toward said drum 3 (in particular after it is inserted inside the enclosure 2) so that the planar surface 20 of this element 21 is parallel to a side 31 of the drum 3.

However and according to another embodiment, the enclosure 2 can be made in two parts movable relative to one another, in particular by sliding in a direction perpendicular to the axis 30 of the drum 3 as will be described below. Each part of this enclosure 2 then includes part of these elements 21, while the other part of this enclosure 2 includes the other part of these elements 21'. Thus, if part of this enclosure 2 is moved relative to the other part of this enclosure 2, the elements 21 (included by this enclosure part 2) move relative to the other elements 21' (included by the other part of this enclosure 2). According to another embodiment, said enclosure 2 can advantageously surround all of the sides (31; 31'; 31") of the drum 3. Such an enclosure 2 is more particularly suitable for treating food products, in particular liquids.

As mentioned above, the enclosure 2 inwardly includes a plurality of planar surfaces (20; 20'; 20") each oriented toward one (31; 31'; 31") of the sides of the drum 3 and extending parallel to such a side (31 7:31'; 31") of the drum 3.

In this respect, it will be noted that the drum 3 can be immobilized relative to said enclosure 2 in such a position. This position can be guaranteed by the aforementioned positioning means.

Another feature is that this drum 3 is mounted rotating inside this enclosure 2 such that, during such a rotation, the sides (31; 31'; 31") of this drum 3 then form an angle with the planar surfaces (20; 20'; 20") of the enclosure 2. This results in mixing of the waves inside the space 4, between the sides (31; 31'; 31") of this drum 3 and the planar surfaces (20; 20'; 20") of the enclosure 2.

As mentioned above, the device 1 includes a support 5, at least partially positioned in said space 4 and designed to receive and transport the products to be treated at least to the inside of the space 4.

In fact, such a support 5 is made from a material transparent to microwaves, more particularly a glass (in particular a glass known under the trade name Pyrex) or a polymer, more particularly a fluorinated polymer (in particular polytetrafluoroethylene, typically known under the trade name Teflon).

Figure 2:
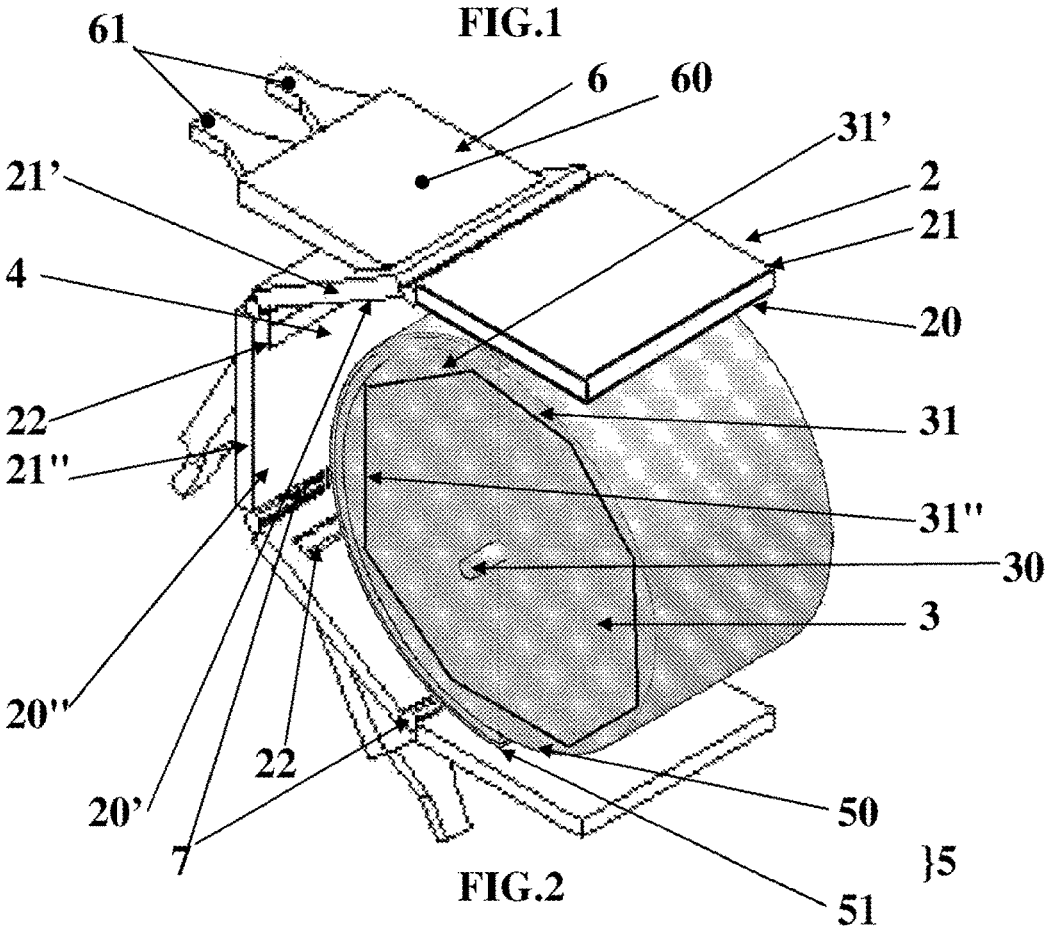
FIG. 2 is a diagrammatic perspective view of an enclosure on the one hand, and an assembly on the other hand, made up of the drum and the support, included by the device according to the invention, and at least part of which is mounted inside the enclosure.

According to one particular embodiment illustrated in FIG. 2, such a support 5 includes a cylinder 50 inside which the drum 3 is positioned (more particularly coaxially), on the one hand, and a mat 51 positioned on the periphery of said cylinder 50, so as to define a cavity with said cylinder 50 for receiving products to be treated, on the other hand.

It will be observed that such a mat 51 can be configured in an arc of circle coaxial with said cylinder 50.

One additional feature relates to the fact that the device 1 includes means for adjusting the distance of the mat 51 relative to the cylinder 50.

Figure 3:
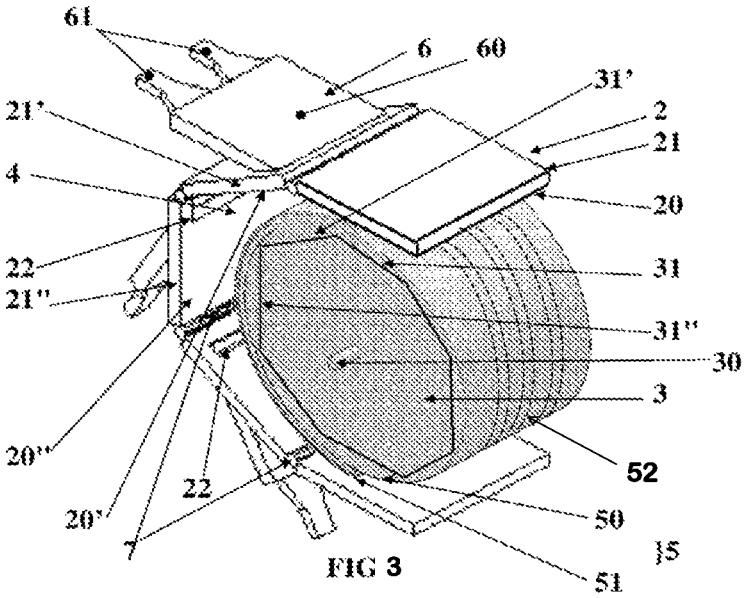
FIG. 3 is a diagrammatic perspective view similar to FIG. 2, in another embodiment including a coil.

Another embodiment shown schematically on FIG. 3 consists of such a support 5 including a coil 52 (in particular made from fluorinated polymer, as mentioned above) wound around the drum 3 and inside which a fluid can flow.

Figure 4:
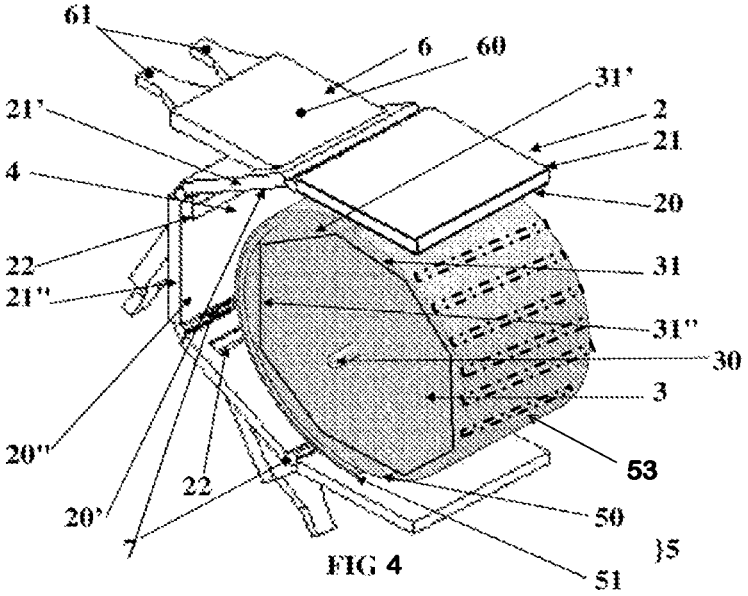
FIG. 4 is a diagrammatic perspective view similar to FIG. 2, in another embodiment including straight tubes.

According to still another embodiment shown schematically on FIG. 4, this support 5 can also include straight tubes 53 (in particular made from glass) equipping said drum 3.

Figure 5:
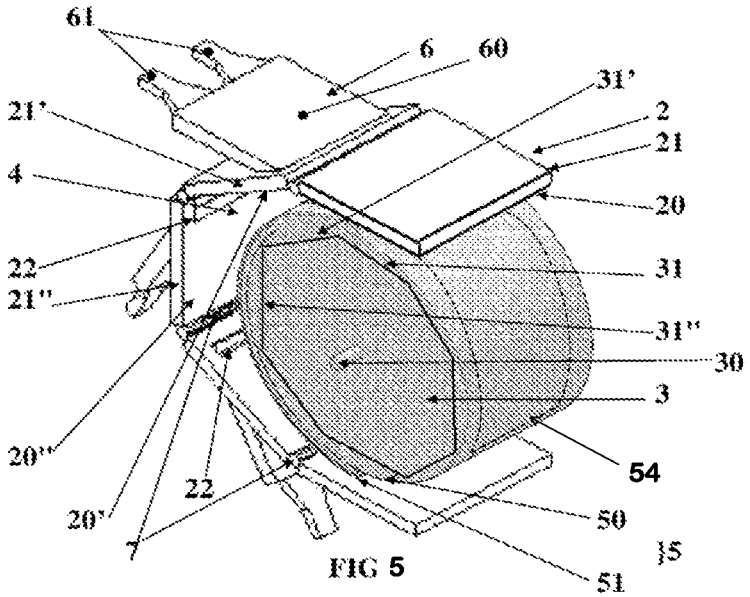
FIG. 5 is a diagrammatic perspective view similar to FIG. 2, in another embodiment including a reactor.

Lastly, in another embodiment shown schematically on FIG. 5, support 5 includes a completely closed circular reactor 54 (able to work in vacuum or under pressure), here again equipping said drum 3. Such a reactor can advantageously be completed by a cooling system.

This coil, these tubes and this circular reactor advantageously make it possible to treat products in fluid form.

Another feature of the invention consists of at least part of the support 5 being movable around the drum 3 or with said drum 3, more particularly around the axis 30 of the drum 3.

In this respect, it will be observed that it is more particularly the cylinder 50 and/or the mat 51 included by the support 5 that are then rotatable, around the axis 30 of the drum 3.

The device 1 then includes means for controlling the movement of the support 5. In particular, these control means include means for imparting a predetermined speed to said support 5, said speed more particularly being adapted to the treatment duration for the products to be treated.

As mentioned above, the device 1 includes a drum 3 mounted rotating around its axis 30.

Also and according to one feature of the invention, this drum 3 and the support 5 are separate and movable (more particularly in rotation), independently of one another and/or with a different speed (more particularly of rotation) from one another.

Such a feature advantageously makes it possible to set the support 5 in motion and, depending on the products to be treated, either to keep the drum 3 immobile (more particularly in a configuration like that described above), or to set this drum 3 in motion (in particular at a speed different from that of said support 5).

Another feature consists of at least the drum 3 and support 5 sliding relative to at least one part of the enclosure 2.

Such sliding is preferably done in a direction perpendicular to the axis 30 of the drum 3.

According to a first embodiment, the drum 3 and the support 5 slide relative to the enclosure 2, which includes at least one articulated (tilting) element 21 as mentioned above, to allow the opening of the enclosure 2 and removal of the drum 3 and the support 3 from said enclosure 2.

According to a second embodiment, the drum 5, the support 5 and part of the enclosure 2 slide relative to another part of this enclosure 2.

In order to allow such sliding, the device 1 includes, on the one hand, a stationary chassis part on which at least part of said enclosure 2 is mounted, and on the other hand, a moving chassis part (more particularly in a direction perpendicular to the axis 30 of the drum 3) relative to the fixed part of this chassis and on which at least said drum 3 and said support 5 are mounted (or another part of the enclosure 2).

Such a feature then advantageously makes it possible to move the assembly formed by the drum 3 and the support 5 (or another part of the enclosure 2), relative to at least part of said enclosure 2. Such a movement can be done in order to conduct a maintenance operation on this assembly and/or to replace and/or modify this assembly.

As mentioned above, the device 1 includes at least one microwave application module 6.

According to the invention, this or these microwave application module(s) 6 each include a waveguide 60, on the one hand, extending toward the space 4 defined between the drum 3 and the enclosure 2 and, on the other hand, designed to introduce, inside this space 4, microwaves in a direction corresponding to the direction of the movement of the products to be treated (inside the space 4) and/or in a direction parallel to one (20; 20'; 20") of the planar surfaces of the enclosure 2.

As shown in the appended figures, such a waveguide 6 has a parallelepiped section, in particular rectangular.

One additional feature is that such a microwave application module 6 (more particularly the waveguide 60 included by such a module 6) is mounted on the enclosure 2, more particularly on an element (21; 21'; 21") included by the enclosure 2, on the side opposite that oriented toward the drum 3.

Such an element (21; 21'; 21") then includes an opening 22 for the passage of the waves and at which the microwave 6 application module 6 is mounted, more particularly the waveguide 60 included by the latter.

Indeed, such a module 6 is mounted on an element (21'; 21"; 21) that is adjacent to an element (21; 21'; 21") of the enclosure 2 defining (with a side 31 of the drum 3 parallel to the planar surface 20 of that element 21) a volume inside which this module 6 introduces the microwaves and/or including the planar surface (20; 20'; 20") parallel to the direction in which the module 6 introduces the microwaves into the space 4.

Another feature is that such a module 6 includes at least one microwave source 61, more particularly in the form of a magnetron or a similar form.

According to still another feature, the device 1 (more particularly the enclosure 2) includes, upstream and/or downstream from the microwave application module(s) 6, at least one means 7 for trapping the waves.

Indeed, such means 7 for trapping the waves consists of a cavity extending parallel to the axis 30 of the drum 3, emerging toward the inside of the enclosure 2, and having an omega-shaped section.

In a first embodiment, the device 1 can include, upstream from a microwave application module 6, such a means 7 for trapping the waves emitted in particular by another microwave application module.

As mentioned above, each planar surface (20; 20', 20") of the enclosure 2 defines, with a side (31; 31'; 31") of the drum 3 that is parallel to this planar surface (20; 20', 20"), a volume inside which a microwave application module 6 introduces the microwaves.

In such a case and according to one preferred embodiment of the invention, the means 7 for trapping the waves introduced in such a volume by a microwave application module 6 is positioned downstream from this module and on the side of this volume opposite the side by which the waves are introduced into this volume by this module 6.

Another feature is that such a means 7 for trapping the waves is inserted between two planar surfaces (20; 20'; 20") included by the enclosure 2, more particularly two adjacent planar surfaces (20; 20'; 20").

In fact and as shown in the appended figures, such a means 7 is more particularly inserted between two of the aforementioned adjacent elements (21; 21'; 21"), included by the enclosure 2, and which include such a planar surface (20; 20'; 20").

In this respect, it will be noted that the device 1 then includes at least one part for connecting two adjacent elements (21; 21'; 21") included by the enclosure 2, such a part including the cavity making up means 7 for trapping the waves.

The presence of such a means 7 for trapping the waves makes it possible to assign each microwave application module 6 a volume (as described above) inside which this module 6 introduces the microwaves. Such a module 6 then includes its own operating enclosure.

The presence of such a means 7 for trapping the waves also makes it possible to prevent the reflection of the waves that could come back to the microwave sources 61, in particular on that having emitted those microwaves.

Lastly, the device 1 includes means for managing its operation. In particular, these management means make it possible to control the power of the modules 6, the movement of the support 5, the maintenance either stopped (for mono-mode use of the device 1) or moving (for multi-mode use of the device 1) of the drum 3.

As mentioned above, the invention also relates to a method for heat treating products by means of microwaves.

According to the invention, this method is carried out by the device 1 described above.

In particular, this method includes a step consisting of introducing, by at least one of the microwave application modules 6, microwaves in said at least one volume defined by one of the planar surfaces (20; 20'; 20") of the enclosure 2 and by one of the sides (31; 31'; 31") of the drum 3, parallel to such a planar surface (20; 20'; 20"), when the drum is immobile relative to the enclosure.

In this respect, it will be observed that this method is carried out when the sides (31; 31'; 31") of the drum 3 are parallel to the planar surfaces (20; 20'; 20") of the enclosure 2, which can be guaranteed by the aforementioned positioning means and which is included by the device 1 according to the invention.

Such a method advantageously allows mono-mode operation of said device 1.

Of course, during such a method, the support 5 is set in motion in order to ensure the circulation of the products to be treated inside the device 1, more particularly inside said space 4.

The invention also relates to another method for heat treating products by means of microwaves implemented using the device described above.

This other method consists on the one hand of rotating the drum 3 around its axis 30 and relative to the enclosure 2, and on the other hand of introducing, by at least one of the microwave application modules 6, microwaves inside the space 4 defined between this enclosure 2 and this drum 3.

Such a method advantageously allows multi-mode operation of said device 1 and ensures mixing of waves inside said space 4.

Here again, the support 5 is set in motion in order to ensure the circulation of the products to be treated inside the device 1.

In this respect, it will be noted that, according to a first alternative of this method, the drum 3 and the support 5 are given a movement with a same speed.

However, and according to one preferred embodiment of this method, the drum 3 and the support 5 are given a movement with different speeds.

This method advantageously on the one hand makes it possible to adapt the length of treatment of the products (by intervening on the speed of the support 5) as a function of the characteristics of these products and, on the other hand, to adapt to the heat treatment needs of the products (by operating on the speed of the drum 3 and therefore on the mixing of the waves).

Lastly, it will be noted that the presence of the management means advantageously makes it possible to ensure only mono-mode, only multi-mode, or both multi-mode and mono-mode (in particular alternating) operation of the device 1, and to go from one to the other during a treatment period.

The invention claimed is:

1. A device for heat treating products by means of microwaves, the device including:

an enclosure;

a drum extending along an axis and at least part of which is mounted inside the enclosure;

a space defined between the enclosure and the drum;

a support, at least partially positioned in said space, and configured to receive and transport the products to be treated;

at least one module for applying microwaves to the products to be treated, the module being configured to introduce microwaves inside the space;

wherein the drum has the form of a prism extending along the axis of the drum and including a plurality of sides extending parallel to an axis of the drum, and wherein the enclosure inwardly includes a plurality of planar surfaces each oriented toward a respective one of the sides of the drum and extending parallel to the respective side of the drum.

2. The heat treatment device according to claim 1, wherein the drum includes at least eight sides.

3. The heat treatment device according to claim 2, wherein the drum includes at least ten sides.

4. The heat treatment device according to claim 2, wherein the drum is rotatable around the axis of the drum.

5. The heat treatment device according to claim 2, wherein the enclosure includes a plurality of adjacent elements each including one of the planar surfaces oriented toward one of the sides of the drum and arranged so as to surround the drum at least partially.

6. The heat treatment device according to claim 1, wherein the drum is rotatable around the axis of the drum.

7. The heat treatment device according to claim 6, wherein the enclosure includes a plurality of adjacent elements each including one of the planar surfaces oriented toward one of the sides of the drum and arranged so as to surround the drum at least partially.

8. The heat treatment device according to claim 1, wherein the enclosure includes a plurality of adjacent elements each including one of the planar surfaces oriented toward one of the sides of the drum and arranged so as to surround the drum at least partially.

9. The heat treatment device according to claim 8, wherein at least one element among the plurality of adjacent elements is movable relative to at least one other element among the plurality of adjacent elements.

10. The heat treatment device according to claim 1, wherein the support is made from a material transparent to microwaves and includes (i) a cylinder inside which the drum is positioned, and (ii) a mat positioned on a periphery of said cylinder, so as to define a first cavity with said cylinder for receiving products to be treated.

11. The heat treatment device according to claim 1, wherein the support includes at least one selected from the group consisting of (i) a coil wound around the drum, (ii) straight tubes equipping the drum, and (iii) a circular reactor.

12. The heat treatment device according to claim 1, wherein at least part of the support is movable around the drum or with the drum.

13. The heat treatment device according to claim 1, wherein the drum and the support are separate and are movable at least one selected from the group consisting of (i) independently of one another and (ii) with a different speed from one another.

14. The heat treatment device according to claim 1, wherein at least the drum and the support slide relative to at least part of the enclosure.

15. The heat treatment device according to claim 1, wherein the microwave application module(s) each include a waveguide extending toward the space defined between the drum and the enclosure and configured to introduce, inside the space, microwaves in a direction corresponding to at least one selected from the group consisting of (i) a direction of movement of products to be treated and (ii) a direction parallel to one of the planar surfaces of the enclosure.

16. The heat treatment device according to claim 1, wherein the device includes, at least one selected from the group consisting of (i) upstream and (ii) downstream from the microwave application module(s), at least one means for trapping the waves, contained within the enclosure and made up of a second cavity extending parallel to the axis of the drum, the second cavity emerging toward the inside of the enclosure and having an omega-shaped section.

17. The heat treatment device according to claim 16, wherein the means for trapping the waves is inserted between two planar surfaces included by the enclosure.

18. A method for heat treating products by microwaves, wherein the method is implemented by the device according to claim 1, and wherein the method comprises:

inserting, by at least one of the microwave application modules, microwaves in at least one volume defined by at least one of the planar surfaces of the enclosure and by at least one of the sides of the drum, parallel to the at least one of the planar surfaces, when the drum is immobile relative to the enclosure.

19. A method for heat treating products by microwaves, wherein the method is implemented by the device according to claim 1, and wherein the method comprises:

ensuring rotation of the drum around the axis of the drum and relative to the enclosure, and introducing, by at least one of the microwave application modules, microwaves inside the space defined between the enclosure and the drum.

20. The heat treatment method according to claim 19, wherein the drum and the support are given a movement with different speeds.

* * * * *